US005483929A

United States Patent [19]

Kuhn et al.

[11] Patent Number: 5,483,929

[45] Date of Patent: Jan. 16, 1996

[54] RECIPROCATING VALVE ACTUATOR DEVICE

[75] Inventors: Damon Kuhn, Frisco; J. M. Johnson, Lewisville, both of Tex.

[73] Assignee: Kuhn-Johnson Design Group, Inc., Lewisville, Tex.

[21] Appl. No.: 279,465

[22] Filed: Jul. 22, 1994

[51] Int. Cl.[6] ..... F01L 1/00; F16K 31/44

[52] U.S. Cl. ..... 123/90.1; 123/90.25; 137/624.13; 251/251; 251/265; 74/57; 74/107; 74/424.8 VA; 74/559

[58] Field of Search ..... 123/90.1, 90.15, 123/90.16, 90.17, 90.22, 90.24, 90.25, 90.27; 137/624.13; 251/251, 265; 74/57, 58, 107, 424.8 VA, 559

[56] References Cited

U.S. PATENT DOCUMENTS

| | | | |
|---|---|---|---|
| Re. 30,188 | 1/1980 | Predhome | 123/90.16 |
| 1,850,544 | 3/1932 | Gray | 123/90.24 |
| 3,952,604 | 4/1976 | Baudler | 74/57 |
| 4,008,625 | 2/1977 | Malhorta | 74/441 |
| 4,022,076 | 5/1977 | Metz | 74/441 |
| 4,031,765 | 6/1977 | Metz | 74/57 |
| 4,256,065 | 3/1981 | Hirt | 74/424.8 VA |
| 4,343,200 | 8/1982 | Alworth | 74/57 |
| 4,522,085 | 6/1985 | Kane | 74/568 R |
| 4,799,644 | 1/1989 | Gaianigo | 74/424.8 VA |
| 5,078,102 | 1/1992 | Matsumoto | 123/90.15 |
| 5,099,805 | 3/1992 | Ingalls | 123/90.24 |
| 5,129,407 | 7/1992 | Phillips | 123/90.18 |
| 5,327,856 | 7/1994 | Schroeder et al. | 123/90.15 |

*Primary Examiner*—Weilun Lo

*Attorney, Agent, or Firm*—George R. Schultz; Harris, Tucker & Hardin

[57] ABSTRACT

A valve activation device having a linear reciprocating cam shaft having longitudinally extending cam grooves that are engaged by captive cam followers which oscillate up and down in response to sideways reciprocation of the camshaft for activating intake or exhaust valves of internal combustion engines or other devices employing reciprocating pistons and valves. The camshaft is caused to reciprocate by a rotary linear converter of the "yankee" type composed of double helix channel at the extreme end of the camshaft and a rotary collar having two sets of diametrically opposed guide members.

19 Claims, 5 Drawing Sheets

RECIPROCATING VALVE ACTUATOR DEVICE

BACKGROUND OF THE INVENTION

This invention relates to various devices for opening and closing valves on internal combustion engines, compressors, and various oil tool field equipment. More specifically it relates to devices which open and close valves in response to rotary motion of a camshaft or crankshaft which allow fluid to enter or escape cylinders which hold a reciprocating piston.

It is well known that the efficiency of an engine or compressor is directly proportional to the rate and volume of intake fluid drawn into the cylinder and exhaust fluid expelled from the cylinder per stroke. The greater the flow rate of intake or exhaust fluid the greater the efficiency of the machine. It has also been recognized in the industry that the efficiency of an engine or compressor can be increased by varying the timing of the intake and exhaust valves with respect to the speed of the engine or compressor and the load placed on the machine. Specifically, the point in time in which the valve opens or closes in relation to the position of the piston in the cylinder and the position of other valves may be adjusted to create optimal flow rates. The optimal flow rates vary depending on how fast the crankshaft is turning and what load is present.

Generally, the prior art teaches that an oblong cam rotating in time with the crankshaft can be used to drive a push rod and rocker arm mechanism to open a valve. A spring is used on the shaft of the valve to close the valve and maintain the rocker arm and push rod in contact with the rotating oblong cam. The prior art also teaches that an oblong cam can be used to drive a valve shaft directly, again relying on a return spring to keep the valve shaft in contact with the cam at all times. In order to vary the timing and the length of time the valve is open, the prior art teaches that the cam diameter or attack angle must be changed responsive to the speed of the crankshaft. Prior art oblong cam driven systems have several limitations. One limitation of all oblong cam driven systems is that the cam can only have a certain limited rate of ascent and descent. Ascent is limited by the mechanical connection between the cam and cam follower; if the ascent rate is too radical a shearing will occur at the cam follower surface. The rate of closure of the valve is controlled by the stiffness of the return spring. At high speeds the valve "float" is problematic. If the cam speed is too high, the strength of the valve return spring cannot close the valve before the cam returns to its open position.

Other valve opening systems are available in the prior art. In one system, disclosed in U.S. Pat. No. 5,078,102 to Matsumoto, the rotating cam is replaced by a stepped cam plate generally perpendicular to the axis of the camshaft. The sliding horizontal cam plate replaces the activating force of a push rod by directly forcing an opposing rocker arm up, thus activating the valve. Timing of an engine equipped with this valve opening system is changed by mechanically lengthening or shorting various mechanical control elements which change the relationship of the cam surface in response to crankshaft's angular position.

Stepped cam plate systems have several limitations. First, they are difficult to implement on existing engines because the travel of the step cam plate is perpendicular to the rotational axis of the crankshaft and camshaft. The system also is difficult to use in retrofitting existing engines. Finally, the timing variation is accomplished by a complex hydraulic system which is difficult to implement and maintain.

U.S. Pat. No. RE. 30,188 to Predhome, Jr. discloses a different system for replacing an oblong rotating cam. This device implements a desmodromic cam and cam follower to convert rotation of a camshaft to rotary oscillation of the cam follower and in turn into activation of the valves. While novel, the system is difficult to use in retrofitting existing engines and retains the need of return springs to close the valves.

BRIEF SUMMARY OF THE INVENTION

The present invention provides a linear reciprocating camshaft having longitudinally extending cam grooves that are engaged by captive cam followers which oscillate up and down in response to sideways reciprocation of the camshaft for operating intake or exhaust valves of devices employing reciprocating pistons and valves, such as internal combustion engines or compressors. The camshaft is caused to reciprocate by a rotary-to-linear converter of the "yankee" type composed of a composite helix channel at an extreme end of the camshaft. The helix channel is acted upon by a rotary driven collar. Valve timing is changed by variably aligning the captive cam followers in relation to the cam grooves on the reciprocating camshafts. The preferred embodiment directly couples the shaft of each valve to the captive cam follower so that the cam follower opens an closes the valve directly.

The present invention satisfies several goals and shortcomings in the prior art. First, it achieves longer power cycles in internal combustion engines because it opens and closes the valves more quickly than can be achieved by a normal cam driven system. In other reciprocating equipment, efficiency is improved by the same mechanism. Second, the invention provides improved valve timing which can be varied depending on engine speed and engine load. Third, the invention provides an improved rotary to linear converter which eliminates torque about the latitudinal axis of the drive collar and thereby reduces friction and increases wear life and reliability of these moving components. Fourth, the preferred embodiment of the invention eliminates the return springs from the conventional valve opening apparatus and therefore improves efficiency by eliminating the need to repeatedly compress the return springs. Fifth, the preferred embodiment increases horsepower in a conventional internal combustion engine by increasing the amount of fuel which can be drawn into the cylinder upon any intake stroke, and exhaust that can be expelled from the cylinder upon any exhaust stroke. Sixth, the invention can be easily manufactured and retrofitted to existing engines, making it widely available to the public.

The invention meets other goals and has other advantages which will be readily apparent from the following detailed description of the preferred embodiment and accompanying drawings. Variations and modifications may be made to the invention without departing from the spirit and scope of the novel concepts of the disclosure.

DETAILED DESCRIPTION OF THE DRAWINGS

Figure 5A:
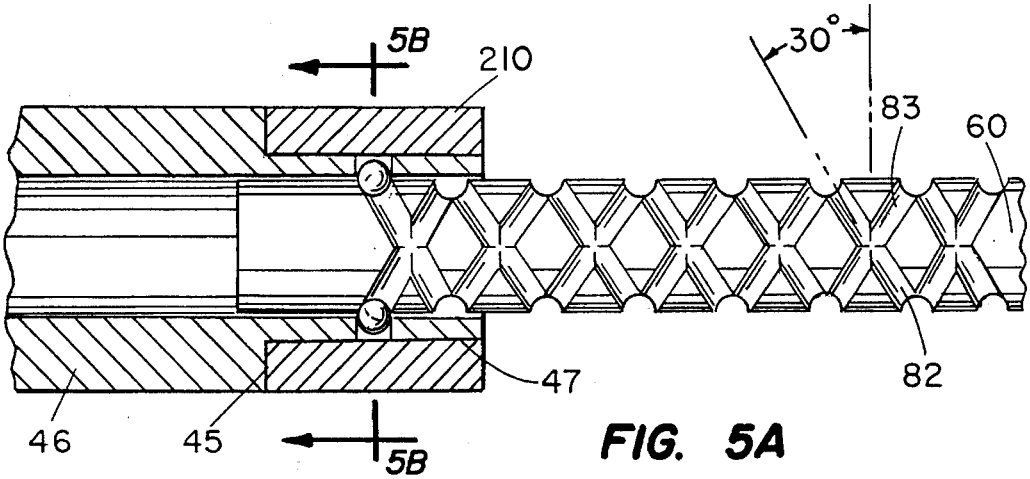

FIG. 5*a* is a cutaway elevation view of the drive collar assembly portion of the invention.

Figure 5B:
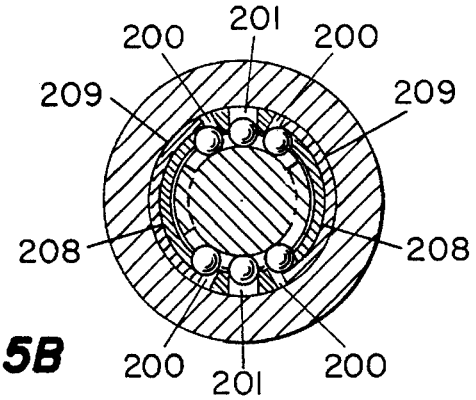

FIG. 5*b* is a cutaway end view of the drive collar assembly portion of the invention.

Figure 5C:
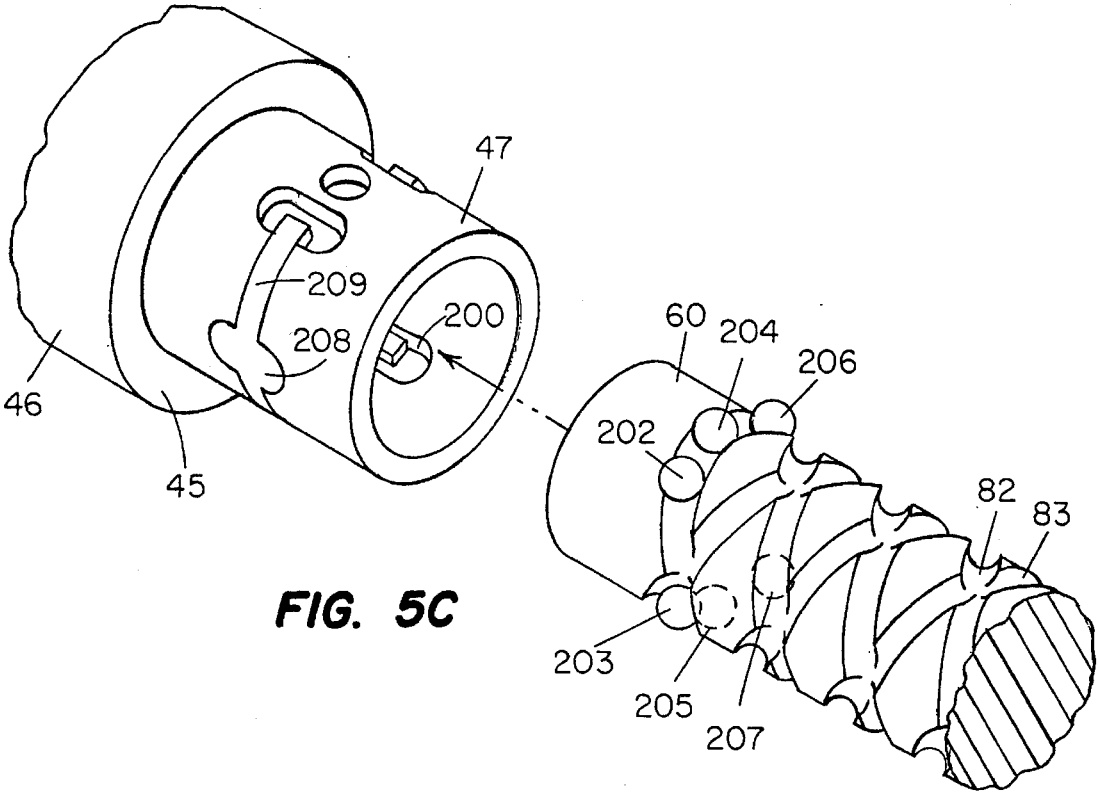

FIG. 5*c* is an exploded isometric of the drive collar assembly portion of the invention.

FIG. 6*a*–6*d* is a schematic drawing showing implementation of the preferred embodiment with a four cylinder engine and positions of the various reciprocating shafts, pistons and valves.

Figure 7:
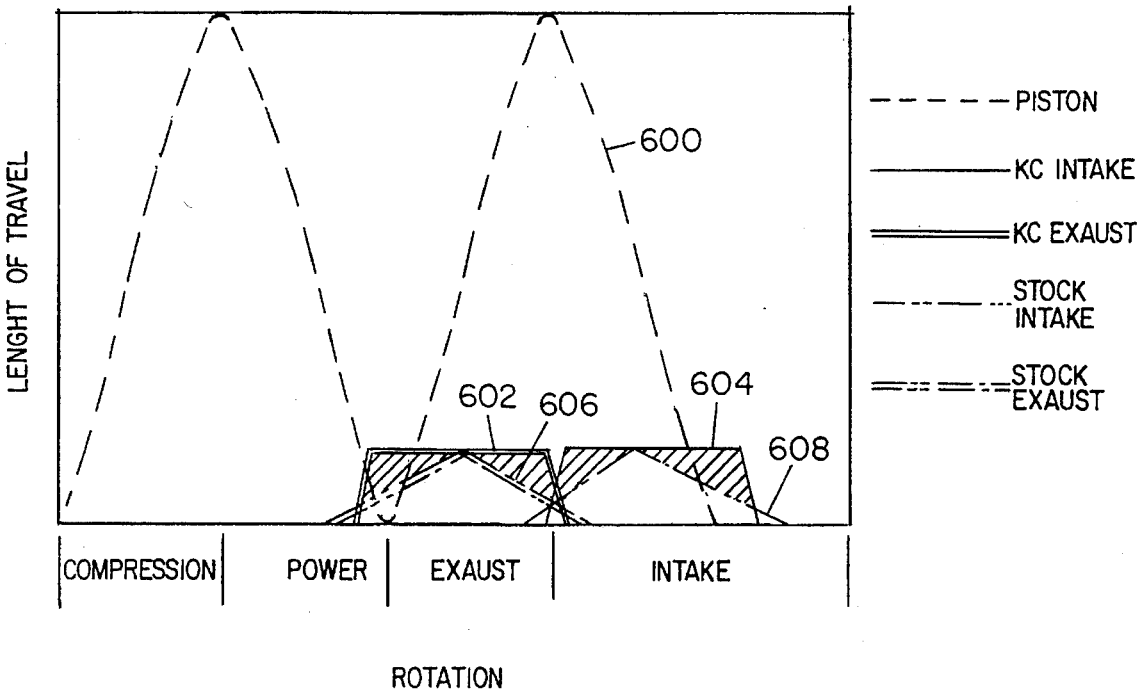

FIG. 7 is a graph of a timing comparison between a conventional camshaft driven valve actuator and the present invention including piston position, intake and exhaust valve positions of the present invention, and intake and exhaust valve positions of the prior art versus camshaft angle.

DETAILED DESCRIPTION OF PREFERRED EMBODIMENT

Figures 1, 3:
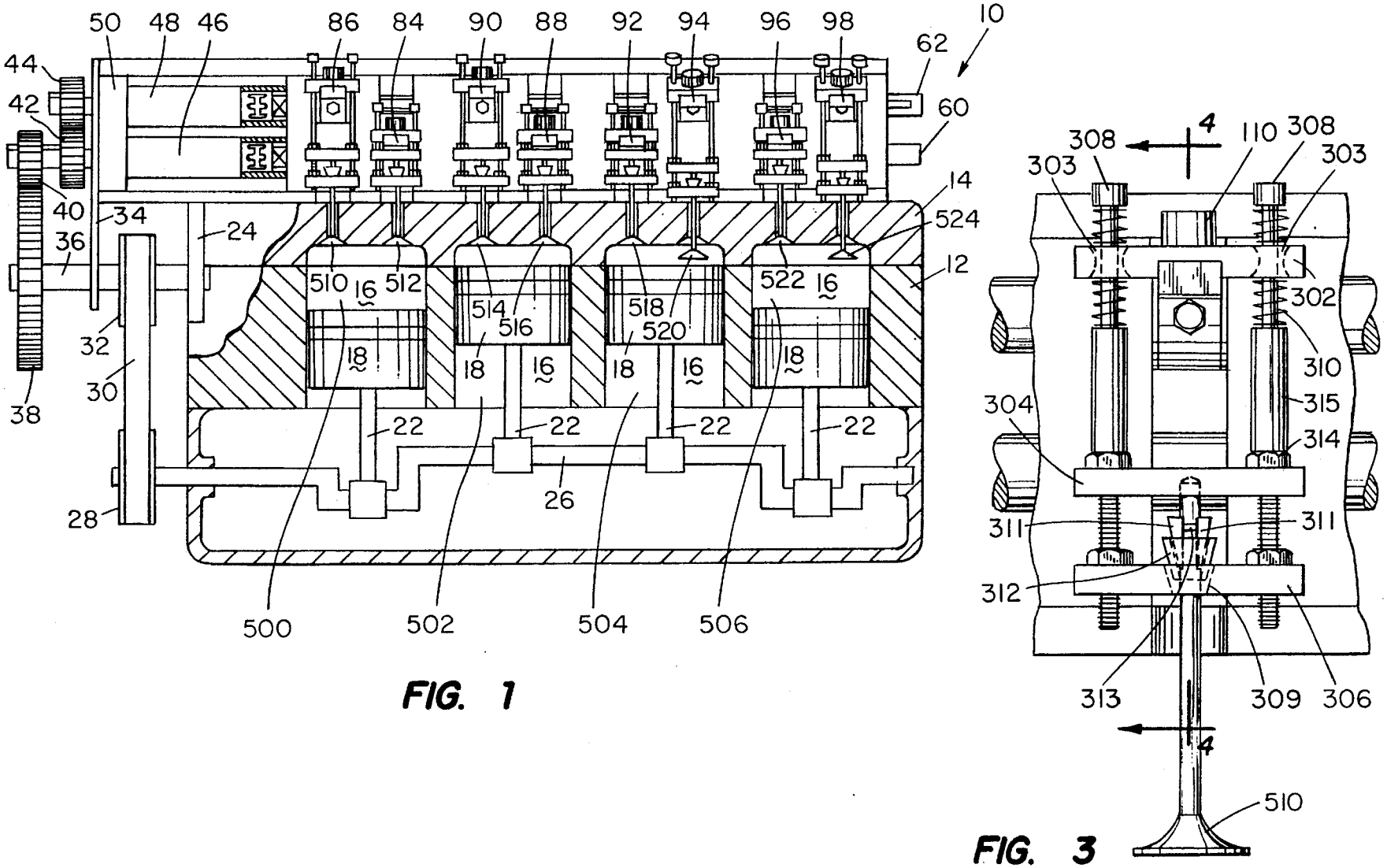
FIG. 1 is a front elevation view of the reciprocating valve actuator device.
FIG. 3 is a cutaway front view of the connector assembly portion of the invention.

Referring to FIG. 1, reciprocating and internal combustion engine 10 has a cylinder block 12 and a cylinder head 14 which define combustion chambers 16 and cylinders. Pistons 18 are mounted for reciprocating movement within cylinders. Connecting rods 22 are pivotally secured to pistons 18 by means of conventional wrist pins [not shown]. The lower end of connecting rods 22 are connected to a conventional crankshaft 26. Main pulley 28 is rigidly connected to crankshaft 26 external to the engine block. Main pulley 28 drives belt 30 and consequently pulley 32, which resides on transmission shaft 36. Both main pulley 28, belt 30 and pulley 32 are matingly notched in order to maintain the timing relation between crankshaft 26 and transmission shaft 36. Transmission shaft 36 is supported by a journal bearing support block 24 and gear plate 34. Transmission shaft 36 extends outward away from gear plate 34 and rigidly engages reduction gear 38. Reduction gear 38 engages reduction gear 40 in a 2:1 ratio whereby reduction gear 40 rotates at exactly twice the speed of reduction gear 38 and consequently twice the speed of crankshaft 26. Reduction gear 40 is rigidly attached to an extended shaft 47 on drive collar 46. Master gear 42 is also rigidly attached to extended shaft 47 of first drive collar 46. Master gear 42 engages slave gear 44. Slave gear 44 is exactly the same diameter as master gear 42 so there is no reduction or increase in rotational speed when the gears are rotated. Slave gear 44 is rigidly attached to the extended shaft 49 of the second drive collar 48. The extended shafts of drive collar 46 and drive collar 48 are supported by journal bearings resident in adjacent support stanchion 50. The journal bearings mentioned are not shown or described in detail because they are conventional and well known in the art.

Figure 2:
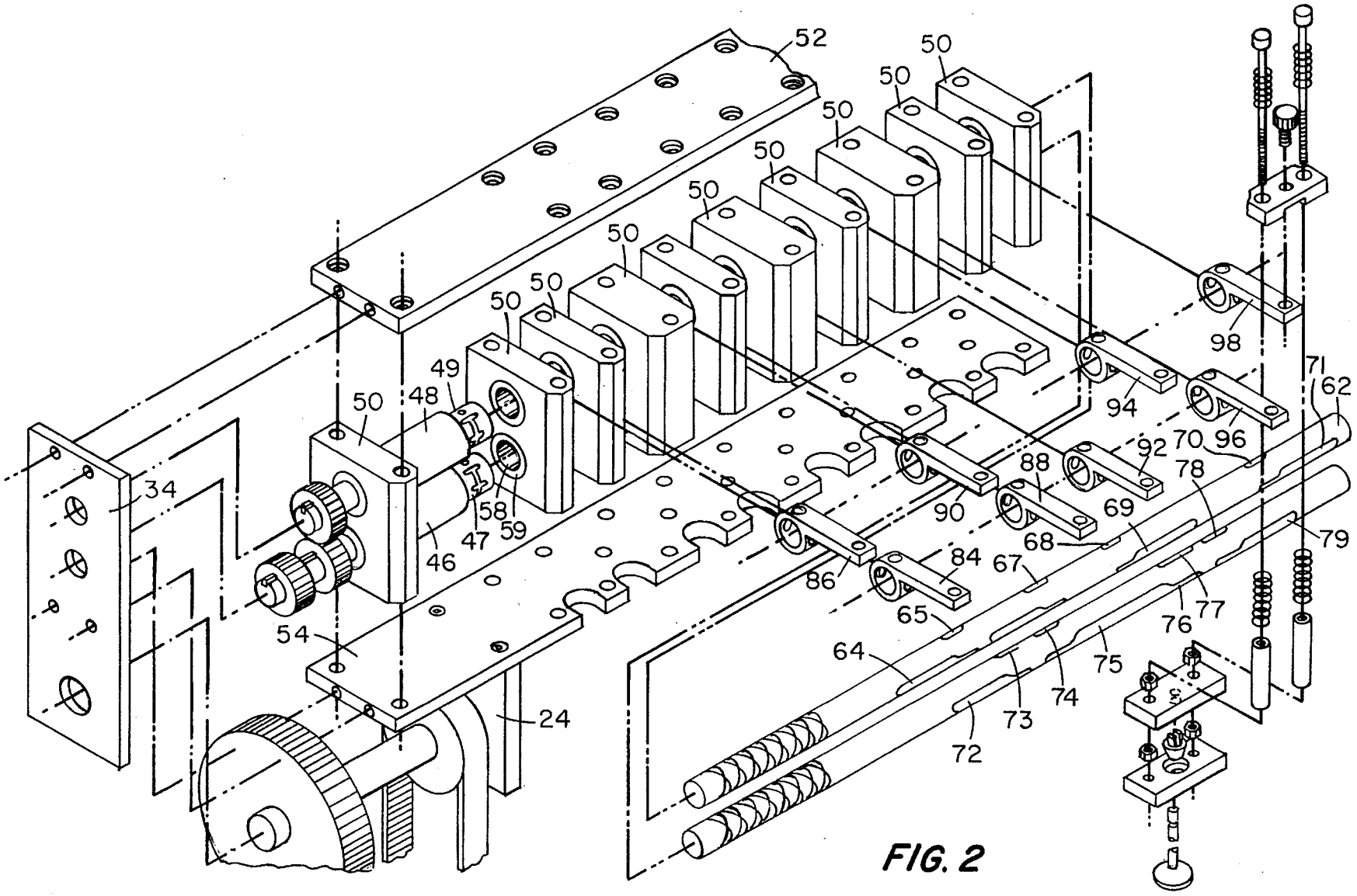
FIG. 2 is an exploded view of the reciprocating valve actuator device.

As can be seen most clearly in FIG. 2, drive collar 46 rotatively engages reciprocating rod 60. Similarly second drive collar 48 rotatively engages the second reciprocating rod 62. Both drive collars are made of "S7" steel in the preferred embodiment. FIG. 5*a*, is a cutaway view of drive collar 46 and shows details of the rotative engagement of the drive collars and reciprocating rods. The details of the rotative engagement between the drive collars and reciprocating rods is the same for each rod/collar combination used in the preferred embodiment, therefore detailed description of only one set will be offered. A shoulder 45 is formed in drive collar 46 to form a reduced diameter portion 47. Drive collar 46 is hollow, having an internal diameter slightly larger than the external diameter of reciprocating rod 60. A telescoping relation is maintained between the drive collar 46 and reciprocating rod 60. Referring to FIGS. 5*b* and 5*c*, four constraining slots 200 and two guide slots 201 are set radially into reduced portion 47. The four constraining slots 200 are arranged in two pairs; the pairs are spaced 120° apart and each slot within the pair is spaced 60° from the other. A guide slot 201 is placed centrally within each pair of constraining slots.

Referring again to FIG. 5*c*, it can been seen that constraining slots 200 are oblong having a left most end a right most end. Guide balls 202,204, 206, 203, 205, and 207 are positioned so that they can roll freely within constraining slots 200 and guide slots 201. Additionally, guide balls 202, 206, 203 and 207 are free to travel from the left most to the right most end of their respective constraining slots. The guide balls are made of carbide with rockwell No. 72 hardness in the preferred embodiment.

Guide balls 202 and 206, and 203 and 207 are alternately constrained in their left most and right most positions by retaining clips 208. Retaining clips 208 are arcurate springs having extended fingers 209. In the preferred embodiment the retaining clips are made of beryllium-copper for resiliency; other materials which offer similar resiliency may be employed. Extended fingers 209 are set into the diameter of reduced portion 47 and follow the circumference of reduced portion 47 terminating halfway across each constraining slot 200. When guide balls 202,203,206 and 207 switch from their left most to right most positions within the constraining slots they slip underneath extended fingers 209.

Still referring to FIG. 5*c*, two continuous helical tracks, 82 and 83, are formed on the end of reciprocating rod 60 and fit within the reduced diameter portion 47 of drive collar 46. Continuous helical track 82 forms a helix traversing the left most end of reciprocating rod 60 in one direction, and then the other. It forms a right hand thread with a pitch of 60° relative to the axis of the reciprocating rod, traverses a smooth turnaround point and then returns forming a left hand thread with a pitch of 60° relative to the axis of the reciprocating rod and finally traverses a second smooth turnaround returning to the right hand thread. Continuous helical track 83 also forms a helix traversing the left most end of reciprocating rod 60. Track 83 forms a left hand thread with a pitch of 60° relative to the axis of the reciprocating rod, traverses a smooth turnaround point and returns, forming a right hand thread with a pitch of 60°, traversing a second turnaround point to return to the left hand thread. The helical tracks 82 and 83 are diametrically opposed and of equal length, so that they form mirror images of each other. Pitch of the tracks is a matter of engineering choice, however the preferred embodiment has been found to work most satisfactorily with a pitch between 55° and 65°.

The reciprocating rods 60 and 62 in the preferred embodiment are made of ¾" bearcat or S7 steel bar stock. To achieve the correct hardness, the bar stock is heat treated after machining to 62 rockwell. Other rod lengths may be employed to accommodate different engine or compressor configurations.

FIG. 5*c* shows that guide balls, 202, 204, and 206 reside in helical track 82 and that guide balls 203, 205, and 207 reside in helical track 83. FIG. 5*a* shows that when the preferred embodiment is assembled, the guide balls are held in the constraining slots and guide slots, and in rotative engagement with the helical tracks by the lock cylinder 210.

In operation, as the drive collar is rotated, the guide balls traverse their respective helical tracks forcing the linear reciprocation of rod 60. As rod 60 nears the limit of its linear travel, guide balls 202 and 206, and 203 and 207 shift positions from right most to left most in their respective constraining slots thereby reversing the travel of rod 60.

The general cooperation of a drive collar constraining balls in slots within a single helical track on a rod is known in the art as a "yankee" type reverser mechanism. One object of this invention, however, is to improve the function of the known "yankee" type reverser mechanisms. Specifically, when only a single set of guide balls is used, as is taught by the prior art, a moment is created about the drive collar perpendicular to the axis of the rod. This moment tends to pivot the entire drive collar causing the collar to bind and malfunction. A major improvement is offered by the addition of a second helical track 83 disposed 180° from helical track 82 on reciprocating rod 60. As can be seen from FIG. 5*b*, guide balls 203,205 and 207 reside in helical track 83 diametrically opposed from guide balls 202, 204 and 206 which are disposed within helical track 82. The addition of a second track and a second group of guide balls eliminates the tendency of the drive collar to pivot about the latitudinal axis of the collar from the moment load imposed by a single set of guide balls. The addition of a second group of guide balls offsets the moment and greatly reduces the tendency of the collar to bind during operation.

Referring again to FIG. 2, it can be seen that drive collars 46 and 48 are supported between support stanchions 50. The stanchions are made of standard cold drawn steel in the preferred embodiment. There are ten support stanchions in the preferred embodiment, each bolted to an upper alignment plate 52 and lower alignment plate 54. Specifically, the support stanchions provide sliding support and lubrication for the reciprocating rods, and constrain the rockers 84, 86, 88, 90, 92, 94, 96 and 98 from linear movement. Each support stanchion 50 has two equally spaced holes 56 and 58. In the preferred embodiment the interior of each holes 56 and 58 are surrounded by bushings 57 and 59, respectively. The interior diameter of bushings 57 and 59 is slightly larger than reciprocating rods 60 and 62. Reciprocating rod 62 is slidingly disposed in bushings 57 and telescopically intercepts drive collar 48 as previously described. Similarly, reciprocating rod 60 is slidingly disposed within bushings 59 and telescopically intercepts drive collar 46. Lubrication is provided by engine oil drip holes (not shown) through stanchions 50.

Referring to FIG. 2, it can be seen that reciprocating rod 60 pivotally supports rockers 84, 88, 92 and 96. Similarly, reciprocating rod 62 pivotally supports rockers 86, 90, 94 and 98. As seen in FIG. 1, rocker 86 is directly adjacent the exhaust valve 510 of cylinder 1, 500. Rocker 84 is held in contact with the intake valve 512 of cylinder 1, 500. Rocker 90 is held in contact with the intake valve 514 of cylinder 2, 502. Rocker 88 is held in contact with the exhaust valve 516 of cylinder 2, 502. Rocker 92 is held in connection with the exhaust valve 518 of cylinder 3, 504. Rocker 94 is held in contact with the intake valve 520 of cylinder 3, 504. Rocker 96 is held in contact with the intake valve 522 of cylinder 4, 506. Rocker 98 is held in contact with the exhaust valve 524 of cylinder 4, 506. Each rocker is constrained from linear movement with respect to the cylinder head 14 by support stanchions 50 on either side of the rocker.

The rockers support the valves through a connector assembly shown best in FIG. 3. Each rocker is attached to its respective valve in a similar fashion so explanation of only one connector assembly will be offered. Each connector assembly consists of a top plate 302, a midplate 304 and a bottom plate 306. Top plate 302 is bolted to the rocker 86 by bolt 110. Standoff bolts 308 connect top plate 302 to midplate 304 by nuts 314, tubes 315 and springs 310. Top plate 302 has two holes 303 which are bored to a wide angle to allow for rocker rotation. Control springs 310 are included between the head of standoff bolts 308 and the top plate to allow for mechanical adjustment of the standoff bolts 308 to the midplate 304. Standoff bolts 308 continue through midplate 304 and into bottom plate 306. Holes are formed in bottom plate 306 which are tapped to receive standoff bolt 308. Each valve shaft passes through hole 309 in bottom plate 306 and is retained in position by the pressure of midplate 304 on the top of the valve shaft and valve retainer 312. Valve retainer 312 engages two cylindrical keepers 311, which in turn engage an annular keeper slot 313 in each valve. When assembled, connector assembly allows each rocker to open and close each valve by an arcurate movement of the actuator about the axis of each reciprocating rod, thereby eliminating the need for return springs.

Figure 4:
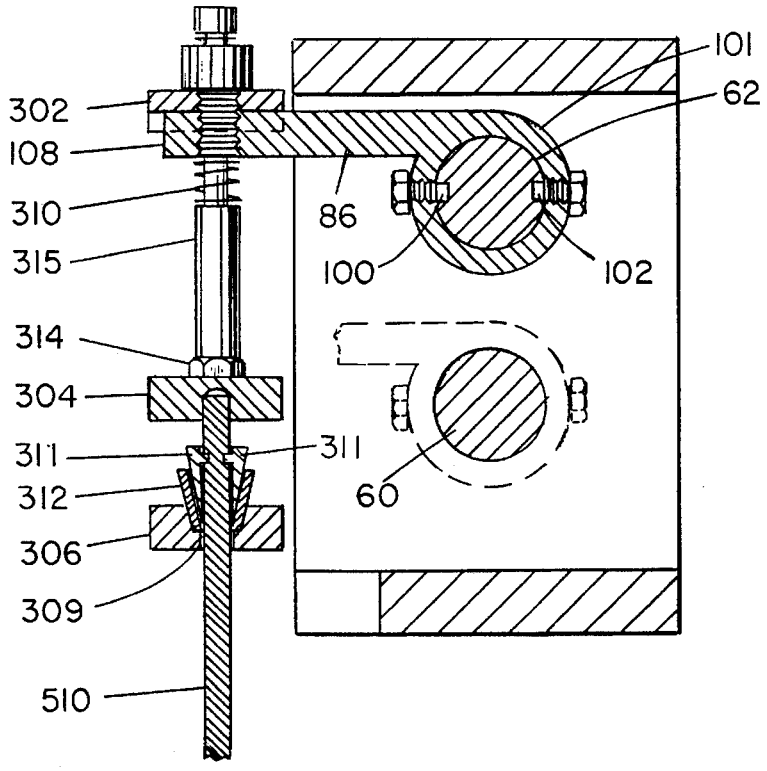
FIG. 4 is a cutaway side view of the connector assembly portion of the invention.

Referring briefly to FIG. 4, a cross section of a connector assembly is shown including the details of each rocker. Each rocker is made up of a body, having a hole 101 for receiving a reciprocating rod, a rocker portion 108 for connection to the connector assembly, a forward actuator pin 100 and a rear actuator pin 102. The pins are disposed within the internal diameter of the hole 101. The pins in the preferred embodiment are made of S7 Steel, and heat treated to a hardness of 58–60 rockwell. The internal diameter of hole 101 is slightly larger than the reciprocating rod and allows the rocker to slide freely over the rod. Forward actuator pin 100 and rear actuator pin 102 engage actuator slots in the reciprocating rods which will be further described below. The rocker portion 108 extends outwardly from the reciprocating rod over the valve and is bolted to each top plate 302 in each connector assembly.

Referring again to FIG. 2, the details of the actuator slots in the reciprocating rods will now be described. Four pair of diametrically opposed actuator slots are cut in the front and back of each reciprocating rod and are sized to receive the forward and back actuator pins on each rocker. Each slot has two levels connected by an angled channel. The front slots' upper level is paired with the back slots' lower level; the front slots' lower level is paired with the back slots' upper level. The angled channel connecting the upper and lower level of the front slot forms a 38° angle with the axis of the rod. If viewed from the same orientation with respect to the axis of the rod, the angled channel connecting the upper and lower portions of the back slot forms a 218° angle with the axis of the rod. Actuator slots 64 and 65 on reciprocating rod 62 are adapted to receive the actuator pins from rocker 86. Actuator slots 66 and 67 are adapted to receive actuator pins of rocker 90. Actuator slots 68 and 69 are adapted to receive actuator pins from rocker 94. Actuator slots 70 and 71 are adapted to receive the actuator pins from rocker 98. Moving to reciprocating rod 60, actuator slots 72 and 73 are adapted to receive actuator pins from rocker 84. Actuator slots 74 and 75 are adapted to receive actuator pins from rocker 88. Actuator slots 76 and 77 are adapted to receive actuator pins from rocker 92 and actuator slots 78 and 79 are adapted to receive actuator pins from rocker 96. Actuator slots 65, 67, 68, 70, 73, 74, 77 and 78 each contact a forward actuator pin; actuator slots 64, 66, 69, 71, 72, 75, 76 and 79 each contact back actuator pins. The pins, slots, support stanchions and timing control fork cooperate so that as the reciprocating rod slides through the rocker, the rocker is forced by the timing control fork and stanchions to rotate about the axis of the rod into one of two positions, raised or lowered.

In operation, crankshaft 26 rotates main pulley 28 and consequently belt 30 and pulley 32. Pulley 32 rotates transmission shaft 36 and reduction gear 38 which in turn rotates reduction gear 40. Reduction gear 40 turns at exactly twice the speed of reduction gear 38 and hence twice the speed of crankshaft 26. Reduction gear 40 rotates master gear 42 with no change in rotation speed; master gear 42 engages slave gear 44 so that slave gear 44 turns with the same speed but in the opposite direction of master gear 42. Master gear 42 rotates first drive collar 46 and consequently rotates constraining slots 200 and guide slots 201 forcing guide balls 202, 204, 206, 203, 205 and 207 to rotate. The guide balls engage the continuous helical tracks 82 and 83 on reciprocating rod 60. Since drive collar 46 is constrained from linear motion by support stanchions 50, reciprocating rod 60 is forced by the guide balls to reciprocate telescopically in and out of drive collar 46. Similar cooperation exists between slave gear 44, drive collar 48, guide balls 202, 204, 206, 203,205, and 207, and reciprocating rod 62 forcing the linear reciprocation of reciprocating rod 62. In the preferred embodiment, reciprocating rod 62 is timed so that it follows reciprocating rod 60 in time by 180° of rotation of crankshaft 26. This timing is necessary because the four cylinder configuration of the preferred embodiment requires that exactly two valves on separate cylinders to be in their full open position approximately every 180° of crankshaft rotation. Other engines, compressor configurations or adaptations employing the disclosed invention may require the reciprocating rods to be timed to lead or follow one another by differing amounts.

As reciprocating rods 60 and 62 move back and forth through support stanchions 50, each rocker rotates in response to its position along the actuator slots in the reciprocating rods. FIGS. 6*a–d* best demonstrates the relationship between the actuator slots, valve positions and piston positions of the preferred embodiment. FIGS. 6*a–d* form a schematic diagram of the piston positions, valve position and rod positions for the invention at various intervals as the crankshaft turns 720°, or 2 complete revolutions. Only one side of the reciprocating rods are shown so only the front set of actuator slots can be seen, specifically actuator slots 64, 66, 69, 71, 72, 75, 76 and 79.

Figure 6A:
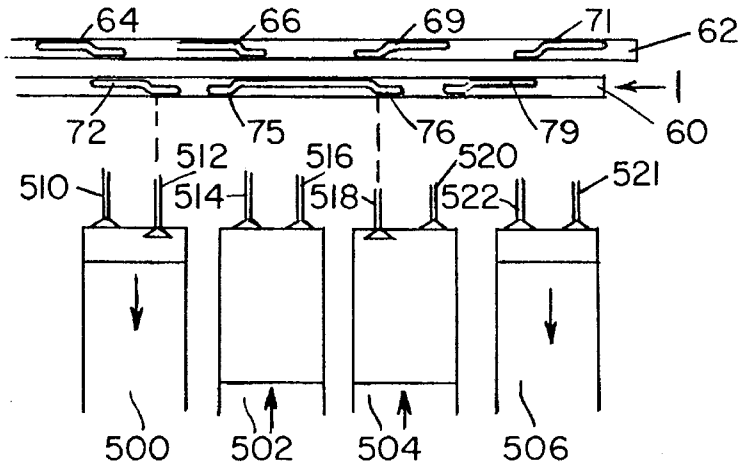

Referring to FIG. 6*a*, at the beginning of intake stroke of cylinder 1,500, reciprocating rod 62 is at its left hand limit, beginning a rightward travel. Reciprocating rod 62 is still traveling leftward following reciprocating rod 60 by 180° of crankshaft rotation. At 0° top dead center the intake valve 512 of cylinder 1, 500 is seen to be open. This corresponds to the lower portion of actuator slot 72. Simultaneously, the exhaust valve 518 must be open. This corresponds to the lower portion of actuator slot 76 directly above exhaust vane 518 on cylinder 3, 504. All of the remaining valves are closed corresponding to the upper portions of the remaining actuator slots.

Figure 6B:
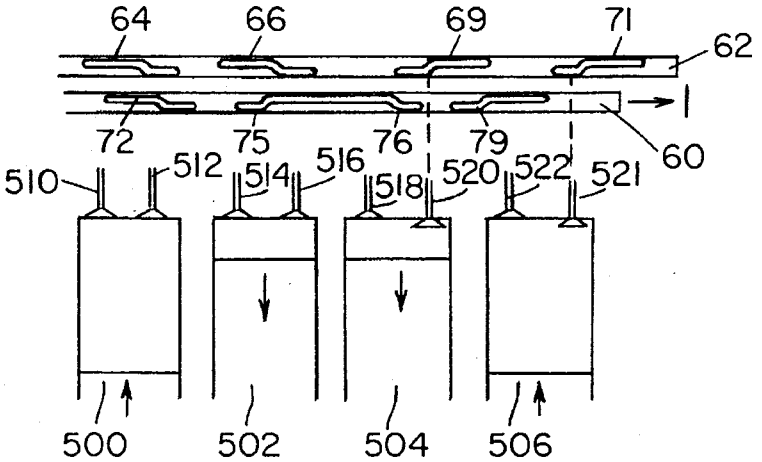

As crankshaft 26 turns to 180° the pistons and valves arrive in the schematic position as shown in FIG. 6*b*. It can be seen that at 180° of crankshaft rotation rod 62 is approaching its fight hand limit position. The intake valve 520 on cylinder 3, 504 must be open, as must the exhaust valve 524 on cylinder 4, 506. Open valve 520 corresponds to the lower portion of actuator slot 69 on reciprocating rod 62. Open valve 521 on cylinder 4, 506 corresponds to the low position on actuator slot 71 on reciprocating rod 62. As before, all other valves are closed corresponding to the upper portions of the remaining actuator slots.

Figure 6C:
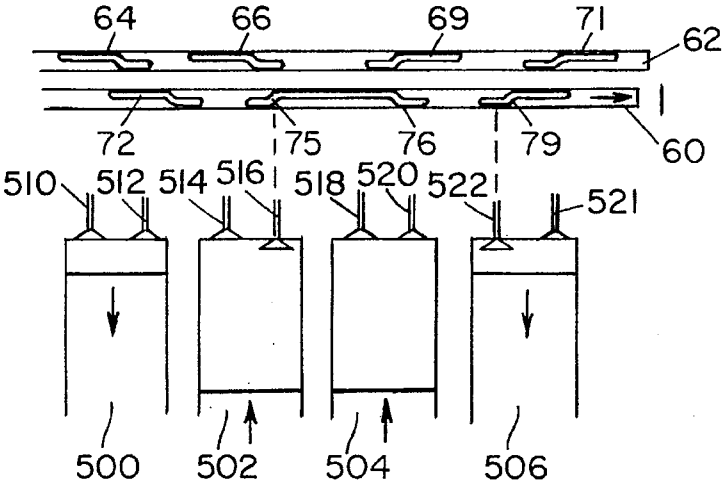

The relative schematic positions of the components after rotation of crankshaft 26 by 360° can be seen in FIG. 6*c*. Exhaust valve 516 on cylinder 2, 502 and intake valve 522 on cylinder 4, 506 must be open. Reciprocating rod 60 is approaching its fight hand limit position, lagging reciprocating rod 62 by 180° as previously described. Open intake valve 522 corresponds to the low position on actuator slot 79 on reciprocating rod 60. Open exhaust valve 516 corresponds to the low portion of actuator slot 75 on reciprocating rod 60.

Figure 6D:
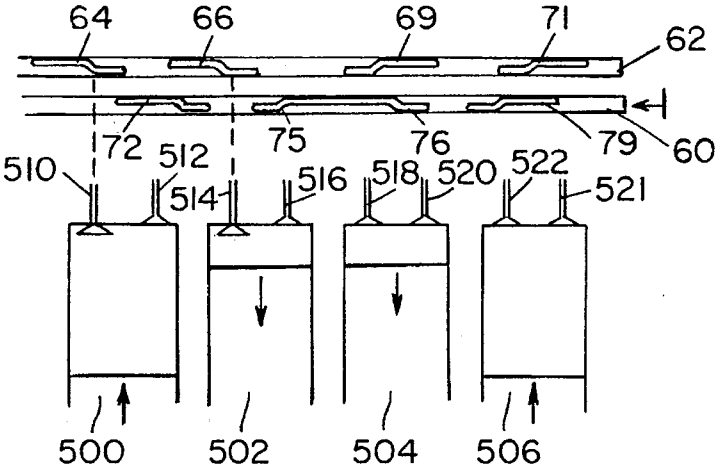

Rotating an additional 180°, the crankshaft arrives at 540° rotation from its original position. Referring to FIG. 6*d*, it can be seen that both rods 60 and 62 are traveling from right to left. Exhaust valve 510 on cylinder 1, 500 must be open, as must intake valve 514 on cylinder 2, 502. These valve positions correspond to the low portion of actuator slots 64 and 66 respectively. Traveling an additional 180° brings the schematic diagram back to FIG. 6*a* where the cycle repeats again.

Some of the advantages of the preferred embodiment of the invention as demonstrated by the preferred embodiment can been seen from FIG. 7. FIG. 7 is a graphical timing comparison between a reciprocating piston internal combustion engine fitted with a conventional cam driven valve system and the same engine fitted with the current invention. Curve 600 represents schematically the piston positions for various degrees of rotation of the camshaft. Curve 602 represents the valve positions of the intake cycle of the preferred embodiment of the invention. Similarly, Curve 604 represents the valve positions of the exhaust cycle of the preferred embodiment of the invention. Curve 606 represents the stock intake valve positions of a conventional cam driven engine and curve 608 represents the stock exhaust valve positions from a conventional cam driven engine. Comparing curves 602 and 606, and 604 and 608, it can easily be seen that the rate at which the intake and exhaust valves are opened and closed occurs in a much narrower range of rotation of the cam shaft for the present invention. The shaded areas 610 diagrammatically illustrate that the amount of time the valves are open per cycle is much greater utilizing the present invention than with a conventional cam driven device. The result is that an engine or other reciprocating piston device drastically improves in efficiency, and in the case of a reciprocating internal combustion engine, power output. Other advantages of the present invention will be readily apparent to those skilled in the art.

It should be understood that various modifications can be made to the embodiment disclosed without departing from the spirit and scope of the present invention. Various engineering changes and choices can also be made without departing substantially from the spirit of the disclosure.

What is claimed is:

1. A valve moving system comprising:

a frame adjacent a valve;

at least one reciprocating rod, having an axis and a stepped cam slot, slidably supported by the frame;

at least one reversing screw, having an axis of rotation parallel to the axis of the reciprocating rod, operatively attached to the reciprocating rod so that the rod is reciprocated when the reversing screw is rotated; and, at least one actuator, operatively connected to the stepped cam slot and to the valve, so that the actuator moves the valve when the rod is reciprocated.

2. The valve moving system of claim 1 wherein:

the reciprocating rod includes two continuous diametrically opposed helical tracks;

the reversing screw includes a plurality of roller guides; and, a cage means, slidably connected to the reciprocating rods, for constraining the motion of the roller guides to the diametrically opposed helical tracks.

3. The valve moving system of claim 2 wherein each roller guide comprises:

a plurality of guide balls.

4. The valve moving system of claim 2 wherein the cage means further comprises:

an inner collar having a plurality of axially elongated grooves for positioning the guide balls in the helical tracks;

a bias clamp adjacent the guide balls for maintaining the guide balls at alternating ends of the elongated grooves; and, a retainer for securing the bias clamp adjacent the guide balls.

5. A valve actuator comprising:

a support structure;

a valve;

a rod, having a continuous helical path and an angled cam surface, held adjacent the valve by the support structure;

a rotatable drive collar engaging the continuous helical path and constrained from linear movement along the axis of the rod, so that the collar slides the rod linearly when the collar is rotated; and, a valve driver, slidably engaging the cam surface and connected to the valve, so that movement of the cam surface causes the valve driver to open or close the valve.

6. The valve actuator of claim 5 wherein the rotatable drive collar comprises:

an alignment cylinder having opposed guide slots;

a plurality of movable guide members slidingly disposed within the guide slots and the continuous helical path; and, a retaining means connected to the alignment cylinder for holding the guide members in the helical path.

7. A valve train actuator comprising:

a valve train including a plurality of valves;

a base plate;

a plurality of guide blocks each having a hole therein, mounted on the base plate to form a cylindrical track;

at least one shaft having at least one bi-level cam slot slidably disposed within the track;

a plurality of rockers slidably disposed on the shaft in contact with the bi-level cam slot;

each rocker constrained by the guide blocks to a position directly adjacent and operatively coupled to one valve in the valve train;

a rotary-to-linear conversion means, operatively attached to the shaft and constrained from linear motion with respect to the shaft by the guide blocks, for translating rotary motion to linear motion of the shaft;

the rockers, shaft, guide blocks and rotary-to-linear conversion means cooperating to oscillate the shaft along its axis upon rotation of the rotary-to-linear conversion means and rotate the rockers about the axis of the shaft in response to pressure from the bi-level cam slot whereby the valve train is actuated.

8. The valve train actuator of claim 7 wherein the rotary-to-linear conversion means includes:

a continuous helical track on the shaft; and, a lead screw coupling, rotatably attached to the shaft through engagement with the continuous helical track.

9. The valve train actuator of claim 7 wherein the rotary-to-linear conversion means includes:

a driver telescopically connected to the shaft;

a plurality of drive balls rotatively and slidably connected to the driver and rotatively disposed within the tracks; and, the shaft includes at least two opposing continuous helical tracks.

10. An internal combustion engine utilizing a valve train actuator comprising;

an engine block having open cylinders and a cylinder head;

a plurality of pistons operatively disposed in the cylinders;

a crankshaft pivotally connected to the engine block and the pistons so that as the pistons reciprocate the crankshaft turns;

a valve train held in sealable relation with the open cylinders by the cylinder head;

a slotted guide member mounted on the cylinder head, forming two longitudinal cylindrical tracks and having one latitudinal slot for each valve;

a first timing bar, having a plurality of tiered camways generally parallel with the axis of the bar at one end and a continuous helical drive path at the other end, slidably disposed in one cylindrical track;

a second timing bar, having a plurality of tiered camways generally parallel with the axis of the bar at one end and continuous helical drive path at the other end, slidably disposed in the second cylindrical track;

a first rotary-to-linear conversion means, operatively attached to the continuous helical drive path of the first timing bar and rotatively coupled to the crankshaft, for the linearly reciprocating the first timing bar once when the crankshaft is rotated through an angle alpha;

a second rotary-to-linear conversion means, operatively attached to the continuous helical drive path of the second timing bar and coupled to the crankshaft, for linearly reciprocating the second timing bar once when the crankshaft is rotated through an angle beta;

a first group of valve drivers slidably mounted on the first timing bar so that each driver fits within one latitudinal slot and contacts one valve of the valve train;

a second group of valve drivers slidably mounted on the second timing bar so that each driver fits within one latitudinal slot and contacts one valve of the valve train;

a plurality of drive pins, each pin rigidly attached to one valve driver and slidably engaging one tiered camway of each timing bar so that as the timing bar linearly reciprocates, the drive pin slides within the tiered camway, forcing the valve driver to rotate about the axis of the timing bar, whereby the valve driver forces the valve it contacts to open or close.

11. An internal combustion engine utilizing the valve train actuator of claim 10 wherein:

angle beta is 720°.

12. An internal combustion engine utilizing the valve train actuator of claim 10 wherein:

angle alpha is 720°.

13. An internal combustion engine utilizing the valve train actuator of claim 10 wherein:

angle beta follows angle alpha by 180°.

14. An internal combustion engine utilizing the valve train actuator of claim 10 wherein: angle beta follows angle alpha by 120°.

15. An internal combustion engine utilizing the valve train actuator of claim 10 wherein the first and second rotary-to-linear conversion means include:

a cylindrical drive collar including an outer retaining ring and an inner guide ring;

the inner guide ring including two diametrically opposed radial holes and four diametrically opposed radial slots such that each hole is equally spaced between two slots;

a guide roller operatively disposed within each hole, held in rolling relation with the helical drive track by the outer retaining ring;

a guide roller operatively disposed within each slot in either a follower or leader position;

clip means, anchored to the inner guide ring, for elastically retaining the guide rollers disposed in the radial slots in alternating leader and follower positions;

the outer retaining ring, radial holes, radial slots, guide rollers, clip means and helical path cooperating to convert rotating motion of the cylindrical drive collar to linear reciprocating motion of the timing bar.

16. An internal combustion engine utilizing the valve train actuator of claim 10 wherein:

the continuous helical drive path includes two identical continuous accurate tracks diametrically opposed with respect to the axis of the timing bar.

17. The internal combustion engine utilizing the valve train actuator of claim 15 wherein the clip means comprises:

two semicircular springs embedded in the inner guide ring.

18. The internal combustion engine utilizing the valve train actuator of claim 17 wherein the semicircular springs are beryllium copper.

19. A method of using a valve moving system which includes a reciprocating rod, having an axis and a stepped cam slot, a reversing screw, having an axis of rotation parallel to the axis of the reciprocating rod, operatively attached to the reciprocating rod so that the rod is reciprocating when the reversing screw is rotated, and an actuator, operatively connected to the stepped cam slot and to the valve, so that the actuator moves the valve when the rod is reciprocated, comprising the steps of:

rotating the reversing screw whereby the reciprocating rod is reciprocated and the valve is moved by the actuator.

* * * * *